US009121132B2

(12) United States Patent
Gozzo

(10) Patent No.: US 9,121,132 B2
(45) Date of Patent: Sep. 1, 2015

(54) APPARATUS AND METHOD FOR TREATING A MESH POCKET OF A LACROSSE STICK

(71) Applicant: Jonathan Gozzo, Hampton, NH (US)

(72) Inventor: Jonathan Gozzo, Hampton, NH (US)

( * ) Notice: Subject to any disclaimer, the term of this patent is extended or adjusted under 35 U.S.C. 154(b) by 0 days.

(21) Appl. No.: 14/174,505

(22) Filed: Feb. 6, 2014

(65) Prior Publication Data

US 2014/0186090 A1 Jul. 3, 2014

Related U.S. Application Data

(60) Provisional application No. 61/748,569, filed on Jan. 3, 2013.

(51) Int. Cl.
*C23C 26/00* (2006.01)
*D06M 23/02* (2006.01)
*A63B 59/02* (2006.01)

(52) U.S. Cl.
CPC ..... *D06M 23/02* (2013.01); *A63B 59/02* (2013.01); *A63B 2209/00* (2013.01)

(58) Field of Classification Search
CPC ..... A63B 59/02; D06M 23/02; C23C 26/00; B05D 1/26
USPC ..... 427/11
See application file for complete search history.

(56) References Cited

U.S. PATENT DOCUMENTS

| | | | | |
|---|---|---|---|---|
| 4,308,633 | A | 1/1982 | Van Huffel et al. | |
| 6,821,303 | B2 | 11/2004 | Polsky | |
| 7,278,936 | B2 | 10/2007 | Tucker, Jr. | |
| 2006/0258488 | A1 | 11/2006 | Lamson et al. | |
| 2009/0258199 | A1 * | 10/2009 | Leveille | 428/196 |
| 2011/0010914 | A1 | 1/2011 | Leveille | |
| 2012/0093565 | A1 | 4/2012 | Drew | |

OTHER PUBLICATIONS

R. B. A Gentleman's Guide to Keeping up Waxed Cotton and Leather, Kempt, (Jan. 2012) http://www.getkempt.com/article/a-gentlemans-guide-to-keeping-up-waxed-cotton-and-leather, on-line, accessed Feb. 25, 2015.*

* cited by examiner

*Primary Examiner* — Kelly M Gambetta
(74) *Attorney, Agent, or Firm* — Mesmer & Deleault PLLC

(57) ABSTRACT

A method of treating a mesh pocket of a lacrosse stick includes providing a solid wax compound, providing a mesh pocket having a plurality of inter-engaged strands that define a plurality of mesh openings, and manually applying the solid wax compound to at least a portion of at least some of the inter-engaged strands of the mesh pocket. A kit for treating a mesh pocket of a lacrosse stick includes a solid wax compound disposed in a retractable applicator, a mesh pocket attached to or attachable to a lacrosse stick, and instructions describing manually applying the solid wax compound to the mesh pocket.

8 Claims, 7 Drawing Sheets

Fig.3
(Prior Art)
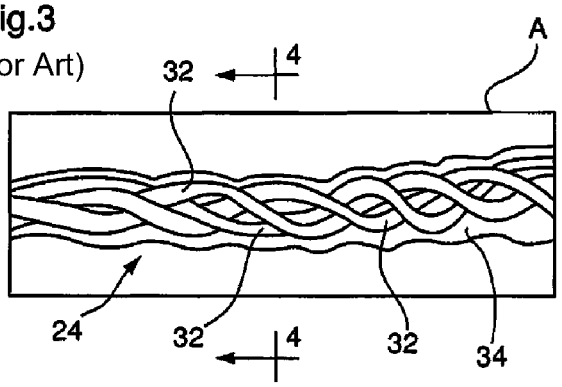
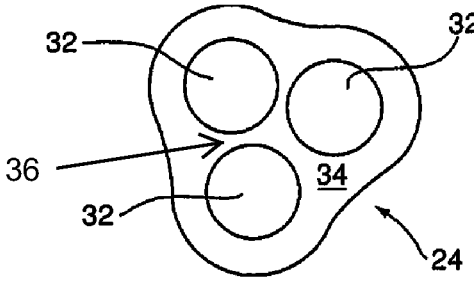
FIG. 4
(Prior Art)

APPARATUS AND METHOD FOR TREATING A MESH POCKET OF A LACROSSE STICK

FIELD OF THE INVENTION

The present invention relates to accessories for lacrosse. More specifically, the present invention relates to an apparatus and method for treating a mesh pocket of a lacrosse stick.

BACKGROUND OF THE INVENTION

Referring to FIG. 1, a lacrosse stick 10 known in the art includes a shaft 14 and a head 16. Head 16 defines a frame 18 that has attached thereto a plurality of strands 24 that are inter-engaged to define a mesh pocket 12, which is supported within frame 18. In use, the user grips the shaft 14 and uses the frame 18 with mesh pocket 12 to cup and support a ball (not shown).

Typically, nylon and leather runners or strands 24 are used to construct the mesh pocket 12. A leather pocket has leather runners that are fixed at the top and bottom of the frame 18. The leather runners are joined to the side of the frame by a nylon rope that is woven to form a net or mesh to hold the ball. The runners are advantageous as they allow the ball to leave the pocket at a relatively high velocity and a high degree of accuracy. One disadvantage of such a construction is that the leather runners are extremely water absorbent and will stretch when wet. Further, when the leather dries, the leather will shrink, which may occur unevenly.

Two types of nylon mesh are used, namely a hard mesh and a soft mesh. A hard mesh allows the ball to leave the stick at a relatively high velocity, similar to that of a mesh with leather runners. However, the mesh has very little give. Accordingly, it is difficult to catch passes and carry the ball in the mesh while running. Further, the ball has a tendency to pop out of the pocket when the stick is "checked."

A hard or firm mesh is obtained by coating nylon strands with a liquid rope whipping agent or stiffening agent. A whipping agent typically is liquid rubber and is applied to the newly-cut end of a rope or line to prevent it from unraveling or fraying. Whipping agents have been used in the past to treat a strand to seal it from the elements and to waterproof the strand. Whipping agents have also been used to coat a strands in a mesh to make a "hard mesh" or at least harder than the mesh as it comes off the loom. Whipping agents, however, do not condition a mesh pocket for a "broken-in feel" nor do they provide tack for ball control.

A stiffening agent is typically a liquid latex rubber and/or an acrylic coating that is sprayed onto the nylon or synthetic strand when the strand is removed from a loom. The amount of stiffening agent used determines how stiff the strands become. Stiffening agents are also used to seal the strand from the elements. Like whipping agents, stiffening agents also do not condition the strands of a mesh to provide a "broken-in feel" nor provide tack for better ball control.

For example, United States patent application publication 2006/0258488 to Lamson discloses coating the mesh with polyurethane elastomer, polyester, vinyl, polyvinylidene fluoride, polypropylene, EVA, ionomer, thermoplastic urethane, and polyamide. According to Lamson, such stiffening agents allow the user to throw the ball faster and with more accuracy. However, the use of stiffening agents may also reduce the ease with which a user may carry or hold the ball in the mesh.

Accordingly, to address the problems of stiffening agents, U.S. Pat. No. 7,278,936 to Tucker discloses coating only a portion of the mesh with a stiffening agent, such that the ball may be held in the coated portion when the user is throwing the ball, and held in the non-coated portion of the mesh pocket when a user is carrying the ball. In the '936 patent to Tucker, the stiffening agent is applied to the stick by spraying, painting, or dipping. A soft mesh, such as a nylon that is not coated with a liquid rope whipping agent, has superior cushioning and holding characteristics, thereby producing a pocket that is better for catching passes, carrying the ball while running, and picking up a ball.

Several methods are known for applying a wax to a substrate such as a fabric or a surface. For example, U.S. Pat. No. 4,308,633 to Van Huffel et al. discloses a method of applying a wax to a surface such as the bottoms of skis. The method includes providing a carrier sheet that is loaded with wax and is substantially impervious to the passage of melted wax therethrough. The carrier sheet is applied to the surface and heated to melt the wax and deposit it on the skis.

Similar to the Van Huffel et al. method, U.S. Pat. No. 6,821,303 to Polsky discloses a method of applying a wax to a cloth material for creating Batik art. The method involves applying a carrier sheet, which is loaded with wax, to the cloth supported on a table or other surface. Pressure is then applied to the carrier sheet to deposit the wax onto the cloth.

Another method includes heating of a mesh pocket and pouring molten wax onto one or more strands of strings within the pocket. For example, U.S. published patent application no. 2011/0010914 A1 to Leveille et al. discloses the need for molten wax in order to permeate the layer of the mesh pocket with an optional step of pre-heating the mesh pocket to apply wax, molten wax, and/or a color to the mesh pocket prior to stringing the pocket. This method requires heating one or both sides of the mesh pocket to allow a molten wax to adhere to the mesh pocket.

SUMMARY OF THE INVENTION

The methods of applying wax as disclosed by Van Huffel et al. and Polsky are applicable to smooth, solid surfaces, such as skis and supported textiles, where the wax is transferred to the substrate and spread across the surface of the substrate by applying pressure. Such a method, however, does not work for a mesh pocket having openings between strands forming the mesh because much of the wax is lost or wasted when it falls through the openings of the mesh pocket. The method also does not work for a mesh that has a relatively uneven surface as is found with a mesh pocket because the wax does not adhere well or absorb into desired portions of the mesh pocket strands.

A deficiency of the method disclosed by Tucker is that the stiffening agent tends to grip the ball as the ball is shot. This undesirably results in the ball having a relatively slower velocity and reduced accuracy.

In the method disclosed by Leveille et al. discussed above, applying molten wax to the mesh pocket must be done prior stringing the completed lacrosse stick head. A problem with this method is that when the wax ceases to be effective, the mesh pocket must be removed from the stick and reprocessed or replaced with a new mesh pocket. Taking apart the stick wastes time and is impractical in a game or practice situation where one lacks the time necessary to disassemble the stick, heat the pocket and wax, apply the wax, allow it to cool, and reassemble the mesh pocket on the stick. Also, due to the heating requirement of both the wax and the mesh pocket, the Leveille et al. method is impractical for game and practice situations where one does not have access to equipment for heating the mesh pocket and the wax.

Accordingly, what is needed is an improved apparatus and method for treating a mesh pocket, such as the mesh pocket of a lacrosse stick.

In one aspect of the present invention, a method of treating a mesh pocket of a lacrosse stick includes providing a solid wax compound and providing a mesh pocket having a plurality of inter-engaged strands that define a plurality of mesh openings. A solid wax compound is pressed or moved against at least a portion of at least some of the inter-engaged strands of the mesh pocket, thereby applying the wax compound to the mesh pocket. If the material of the strands is able to absorb the wax compound, then the wax compound may be absorbed into the material of the strands themselves.

In other embodiments, the strands of the mesh pocket are made from a synthetic material, e.g., nylon or polyester, which is not permeable to the wax compound. In such a case, the stands may be made from a plurality of elongate members and the wax compound may be manually pressed into the strands by being deposited in the interstitial spaces between adjacent elongate members.

In another embodiment of the method, the step of providing a mesh pocket includes providing a lacrosse stick having a head portion with the mesh pocket secured to the head portion.

In another embodiment of the method, each of the plurality of inter-engaged strands includes a plurality of elongate members and the step of manually applying the solid wax compound includes pressing the solid wax compound into interstitial spaces between adjacent ones of the plurality of elongate members.

In another embodiment of the method, the solid wax compound is disposed within a retractable applicator where the retractable applicator is adjustable to move the solid wax compound to extend beyond a distal end opening of the retractable applicator.

In another embodiment of the method, the retractable applicator has a removable cap and the method includes the step of pressing the removable cap against the inter-engaged strands of the mesh pocket used on a lacrosse stick to cause the solid wax compound to penetrate a wax-permeable layer of the inter-engaged strands of the mesh pocket.

In another embodiment of the method, each of the plurality of inter-engaged strands is made of nylon and lacks a liquid rope whipping agent. In another embodiment, each strand is made of polyester.

In another embodiment of the method, the solid wax compound includes at least one component that is a petroleum wax, a vegetable wax, a mineral wax, an animal wax, a synthetic wax, and a paraffin wax.

In another embodiment of the method, the step of manually moving the solid wax compound against each of the plurality of inter-engaged strands of the mesh pocket includes impregnating substantially all portions of substantially all of the inter-engaged strands with the solid wax compound.

In another embodiment of the method, the step of manually moving the solid wax compound against the inter-engaged strands of the mesh pocket includes applying the solid wax compound to a first side and to an opposite second side of the mesh pocket.

In another aspect of the present invention, an apparatus for applying a solid wax compound has a tubular body with a distal end opening. A solid wax compound is disposed within the tubular body. The apparatus includes a means for advancing the solid wax compound through the tubular body to extend beyond the distal end opening.

In another embodiment of the apparatus, the tubular body has a cross-sectional shape selected from the group consisting of a circle, an oval, and a polygon. Preferably, the cross-sectional shape of the tube has a minimum dimension that is greater than an average diameter of the plurality of mesh openings.

In another embodiment, the apparatus also includes a cap removably attachable over the distal end opening.

In another aspect of the present invention, a treatment kit for a lacrosse stick mesh pocket includes a solid wax compound disposed in a retractable applicator, a mesh pocket having a plurality of inter-engaged strands and attachable to a lacrosse stick, and instructions describing manually applying the solid wax compound to at least a portion of at least some of the plurality of inter-engaged strands of the mesh pocket.

In another embodiment of the kit, the instructions further describe using a cap of the retractable applicator to press against the inter-engaged strands with the solid wax compound applied thereto to impregnate the solid wax compound into the inter-engaged strands.

In another embodiment of the kit, the instructions further describe breaking-in the solid wax compound applied to the inter-engaged strands by throwing and catching a lacrosse ball for at least thirty minutes.

In another aspect of the present invention, a method of using a solid wax compound includes the steps of manually applying a solid wax compound to inter-engaged strands of a mesh pocket attached to or attachable to a lacrosse stick and using a smooth solid surface to press against the inter-engaged strands with the solid wax compound applied thereto, thereby impregnating the inter-engaged strands with the solid wax compound to provide the mesh pocket with a memory characteristic.

Embodiments of the present invention are advantageous because the wax compound provides the ability to throw a ball with speed and accuracy. The present invention also allows the ball to be held longer and carried with ease because of a tacking agent present in the wax compound.

Additionally, embodiments of the present invention are advantageous as the wax provides water resistance to the strands. That is, the wax reduces the amount of water that is absorbed into the strands. This in turn reduces the amount that the strands stretch when the stick is used.

Additionally, embodiments of the present invention are advantageous because the wax allows the pocket to retain its shape.

In some embodiments, each strand comprises a plurality of elongate members, and the wax is positioned between the elongate members.

In some embodiments, the wax is at least one of a petroleum wax, a vegetable wax, a mineral wax, an animal wax, a synthetic wax, and a combination thereof. In some further embodiments, the wax is a paraffin wax.

In some embodiments, strands of the mesh pocket comprise elongated members of nylon or polyester.

In some embodiments, the wax is applied as a solid that contours to the mesh pocket upon application. Such embodiments may be advantageous because the wax may penetrate deeply into the strands.

In some embodiments, the mesh pocket has a plurality of openings between adjacent strands and the openings have an absence of wax.

In some embodiments, the wax is impregnated into an entire portion of all of the strands.

In some embodiments, the wax is impregnated into all portions of all of the strands.

In another broad aspect, a process for applying a wax to a mesh of a lacrosse stick is provided. The process comprises manually applying the solid wax by pressing the wax into the wax-permeable layer. The process further comprises providing wax in a solid state that is in a retractable applicator to the first and second opposed side of the wax-permeable layer. The wax passes through a wax-permeable layer of the mesh.

Embodiments of the present invention may allow for the wax to be impregnated (pushed into each strand of the nylon or treated nylon) into the mesh with or without filing the openings in the mesh. Embodiments of the present invention may be advantageous because the wax may provide increased durability to the strands and promote longevity of the mesh pocket. Embodiments of the present invention also provide a "broken-in feel" to a mesh pocket.

Embodiments of the present invention have the advantage of the tube itself containing the solid wax compound where it is stored until the time of use and then used by the end user as needed.

In some embodiments, the wax compound will work its way out of the mesh pocket with continued use. Such embodiments are advantageous should the user want to discontinue with a wax permeable mesh pocket.

These and other advantages of the present invention will be more fully and particularly understood in connection with the following description of the preferred embodiments of the invention.

BRIEF DESCRIPTION OF THE DRAWINGS

FIG. 3 is an enlarged view of a strand from area A of FIG. 1.

FIG. 4 is a cross-section of the strand of FIG. 3 taken along line 4-4.

DETAILED DESCRIPTION OF THE PREFERRED EMBODIMENTS

Figure 1:
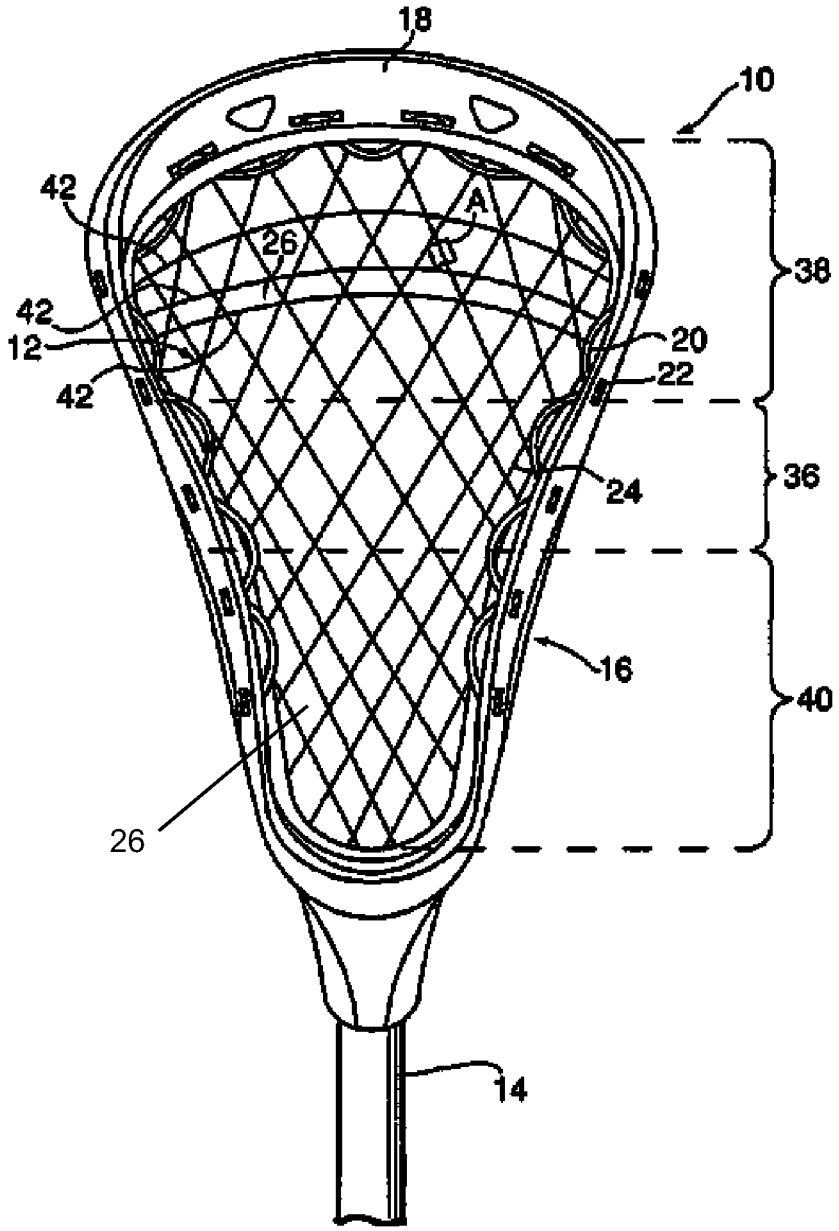
FIG. 1 (Prior Art)
FIG. 1 is a front view of part of one embodiment of a lacrosse stick with a mesh pocket as known in the art.
Figure 5:
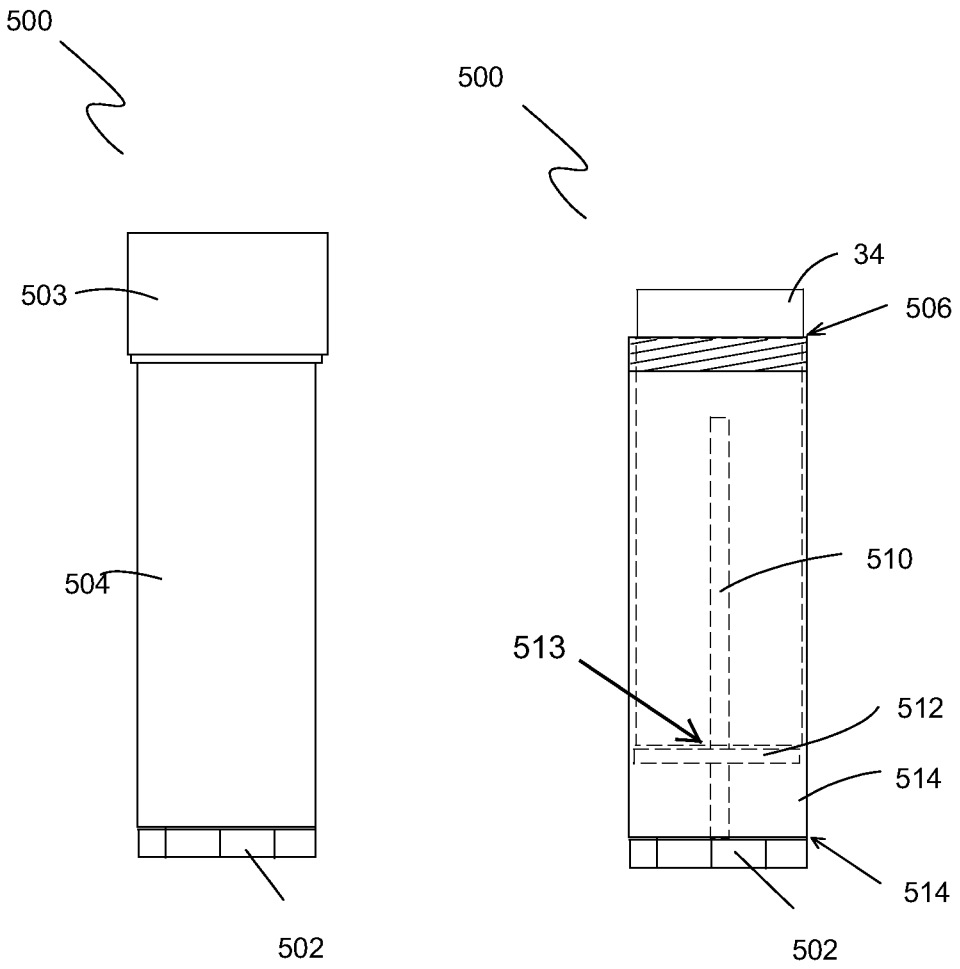
FIG. 5 illustrates one embodiment of a retractable applicator and steps of one embodiment of a method of treating a mesh pocket of the present invention.
Figure 6:
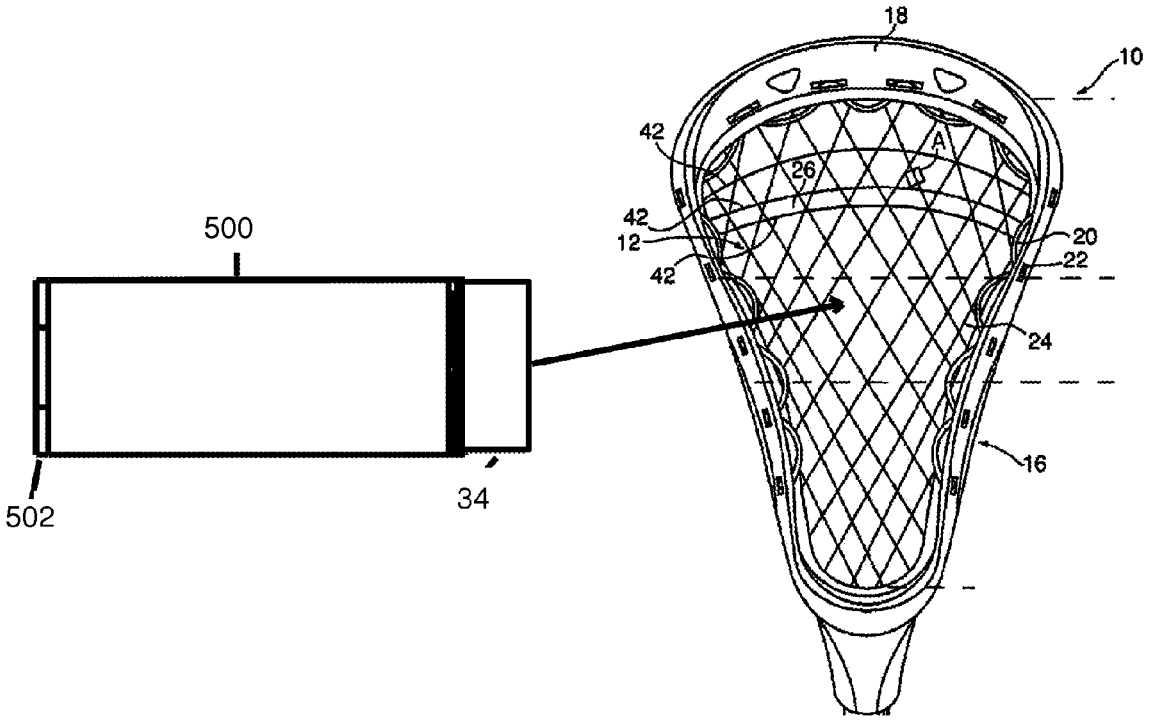
FIG. 6 illustrates a retractable applicator without a cap is shown alongside a head portion of a lacrosse stick as useful in performing steps of one embodiment of a method of treating a mesh pocket of the present invention.
Figure 7:
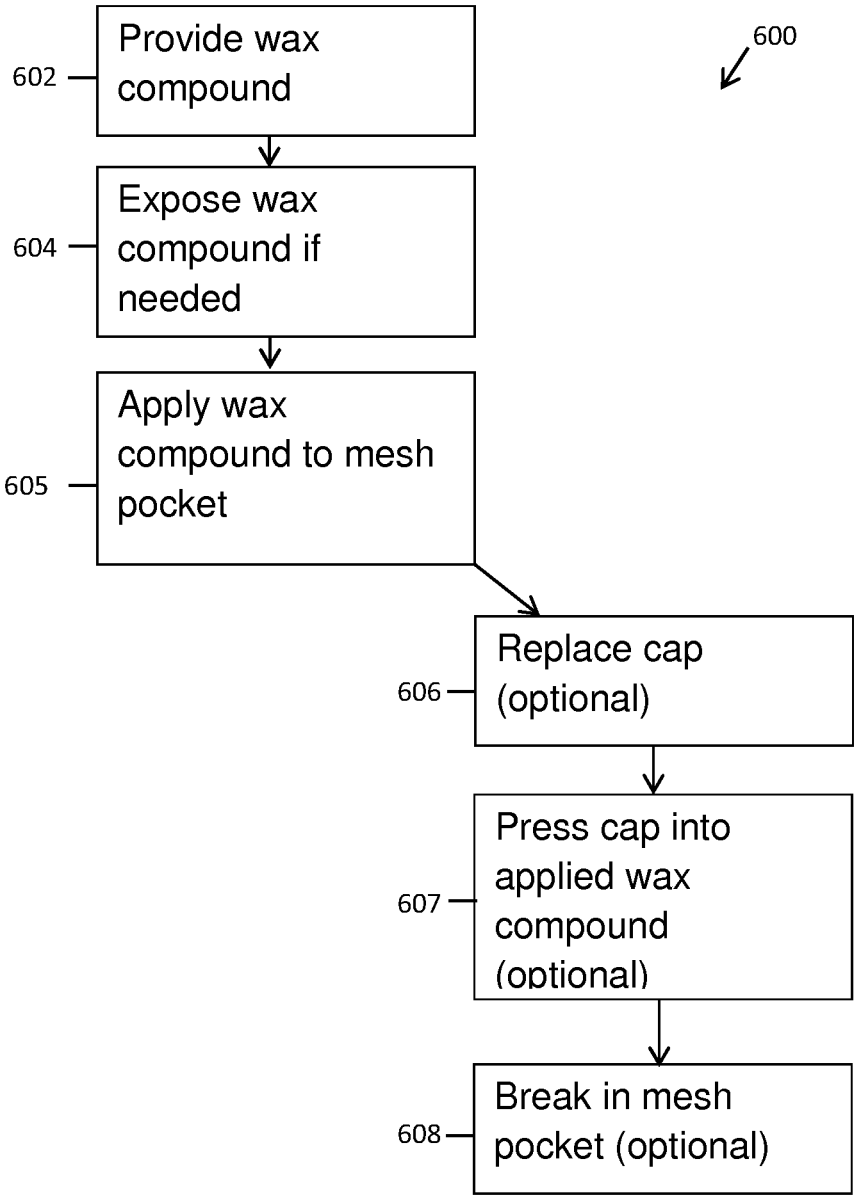
FIG. 7 is a flow chart illustrating steps of an embodiment of a method of treating a mesh pocket of the present invention

FIGS. 1-4 illustrate embodiments of a lacrosse sticks and mesh pockets as known in the art. Preferred embodiments of the present invention are illustrated in FIGS. 5-7. Referring to FIG. 1, a portion of a lacrosse stick 10 comprising one embodiment of a mesh pocket 12 of the prior is shown. Lacrosse stick 10 comprises a shaft 14 and a head 16. Head 16 comprises a frame 18, which supports mesh pocket 12. In the embodiment shown, mesh pocket 12, is secured to frame 18 by a securing member 20, which is woven between portions of mesh pocket 12 and openings 22 provided in frame 18. Mesh pocket 12 has an upper portion 28, a middle portion 36, and a lower portion 40. In other embodiments, mesh pocket 12 may be secured to frame 18 in another manner. Lacrosse stick 10 may be of any design known in the art.

It will be appreciated that mesh pocket 12 may be secured to frame 18 or separate from frame 18. For example, mesh pocket 12 may be sold as a replacement part to be secured onto a pre-existing frame 18. Furthermore, mesh pocket 12 may be pre-formed, or may be formed onto frame 18 after securing mesh pocket 12 to frame 18.

Mesh pocket 12 is defined by a plurality of strands 24 which are inter-engaged as is known in the art to form an expanse of mesh having openings 26 between adjacent strands 24. Any construction known in the art may be used.

For example, strands 24 may be woven, knotted, spun, intertwined, welded, or otherwise interconnected to form mesh pocket 12. Strands 24 may be inter-engaged in a variety of ways to form various configurations of mesh pocket 12. For example, in the embodiments shown in FIGS. 1 and 2*a*-2*c*, strands 24 are inter-engaged, for example by being intermittently connected to one another along their lengths, to form a mesh pocket having diamond-shaped openings 26. In other embodiments, openings 26 may be round, rectangular, or have other shapes.

Figure 2A:
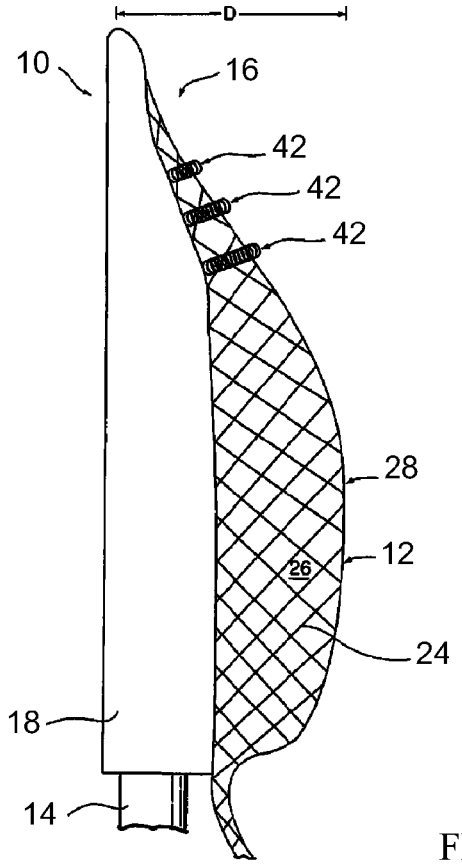
FIG. 2a (Prior Art)
FIG. 2*a* is a side view of the head portion of the lacrosse stick of FIG. 1 showing the mesh pocket configured as a regular pocket.
Figure 2B:
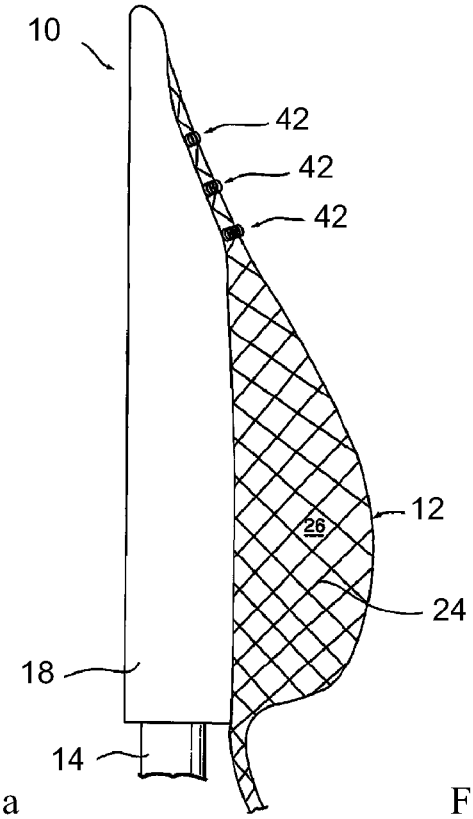
FIG. 2b (Prior Art)
FIG. 2*b* is a side view of the head portion of the lacrosse stick of FIG. 1 showing the mesh pocket configured as a low pocket.
Figure 2C:
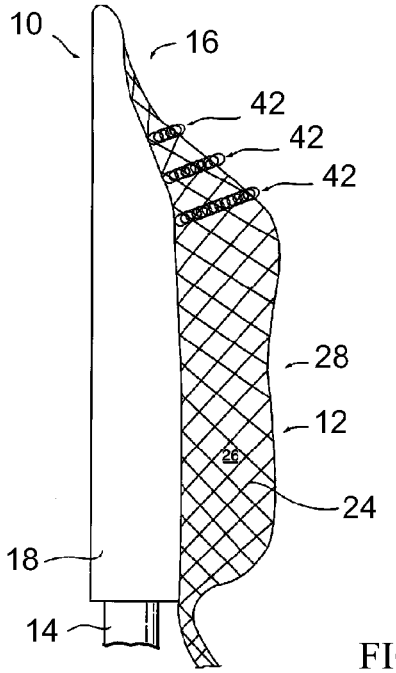
FIG. 2c (Prior Art)
FIG. 2*c* is a side view of the head portion of the lacrosse stick of FIG. 1 showing the mesh pocket configured as a high pocket.

Referring now to FIGS. 2*a*-2*c*, side views are shown of the head portion 16 of lacrosse stick 10 of FIG. 1. Strands 24 are inter-engaged to form a mesh pocket 12 having a variety of depths D. For example, when viewed from the side, as shown in FIGS. 2*a*-2*c*, mesh pocket 12 has a concavity or profile 28 having a depth D. Additionally, strands 24 are inter-engaged to form a mesh pocket 12 suitable for being secured to a variety of frames 18 of different shapes.

The profile 28 of pocket 12 may be varied, such as by adjusting shooting strings 42. By tightening shooting strings 42, a regular pocket as exemplified in FIG. 2*a* may be configured as a low pocket as exemplified in FIG. 2*b*. Conversely, by loosening shooting strings 42, a regular pocket as exemplified in FIG. 2*a* may be configured as a high pocket as exemplified in FIG. 2*c*.

It will be appreciated that the plurality of strands 24 preferably comprises a plurality of distinct strands 24 that together form mesh pocket 12.

Strands 24 may be fabricated from a variety of materials. Any material known in the lacrosse arts may be used. Such materials include, but are not limited to, nylon, leather, and polyester. Furthermore, in some embodiments, mesh pocket 12 may comprise a mixture of different materials. For example, mesh pocket 12 may comprise a plurality of nylon strands, a plurality of leather strands, and a plurality of polyester strands. Preferably, strands 24 are nylon or polyester (e.g., a soft nylon or polyester mesh) that is not coated with a liquid rope whipping agent.

Referring now to FIG. 3, an enlarged view of one strand 24 is shown from area A of FIG. 1. In some embodiments as exemplified in FIG. 3, each strand 24 comprises a plurality of elongate members 32. For example, a plurality of nylon or polyester elongate members 32 may be spun, woven or braided together to form strand 24. It will be appreciated that each elongate member 32 may itself be formed of a plurality of members that are spun, woven or braided together.

Referring to FIG. 4, a wax compound 34 is shown impregnated into strand 24. As used herein, the term "impregnated" or "pressed into" means wax compound 34 penetrates beyond the surface of strand 24 to occupy interstitial spaces between elongated members 32 and/or to be absorbed into strand 24.

For example, wax compound 34 may be absorbed into the material forming strand 24. Alternatively, or in addition, as exemplified in FIG. 4, wax compound 34 may penetrate into the interstitial or open space 36 between at least some of the adjacent elongate members 32 of strand 24, where wax compound 34 is positioned in at least a portion of the interstitial space 36 between adjacent elongate members 32.

In some embodiments, wax compound 34 is impregnated into at least a portion of at least some of strands 24 of mesh pocket 12. Preferably, wax compound 34 is impregnated into at least a portion of all of strands 24. More preferably, wax compound 34 is impregnated into all or substantially all of strands 24. Accordingly, wax compound 34 substantially coats all surfaces of mesh pocket 12.

Preferably, wax compound 34 is applied to mesh pocket 12 as a solid in order to impregnate strands 24, as will be further described herein below. More preferably, wax compound 34 is applied in such a manner so as to not fill mesh openings 26 between adjacent strands 24.

Referring now to FIG. 5, a retractable applicator 500 is shown and includes wax compound 34 disposed within a tubular body 501, a means 513 for advancing wax compound 34 through tubular body 501, and a removable cap 503. Means 513 for advancing wax compound 34 include a threaded rod 510 with push plate 512 within tubular body 504. A rotating dial 502 is located outside a proximal end 514 of tubular body 504 and connected to threaded rod 510, where rotating dial 502 advances push plate 512 along threaded rod 510 to move wax compound 34 through tubular body 504. Means 513 also includes push plate 512 that the user manually advances through tubular body 504 by pressing against it via an open proximal end 514 of tubular body 504 (shown obstructed by rotating dial 502 in FIG. 5). Other means 513 known in the art are acceptable for advancing wax compound 34 through tubular body 504, such as those used for lip balm, lip stick, ice cream, and the like.

In one embodiment, wax compound 24 is applied to mesh pocket 12 using retractable applicator 500. After applying wax compound 34 to strands 24, removable cap 503 (e.g., a twist-on cap or snap-on cap) is placed back onto an open distal end 504 of tubular body 501. Removable cap 503 is preferably made of smooth plastic, but may be made of other materials with smooth or slightly-roughened surfaces. Removable cap 503 is then used to further impregnate mesh pocket 12 with wax compound 34 by pressing removable cap 503 against wax compound 34 applied to strands 24. Pressing removable cap 503 against strands 24 with wax compound 34 applied thereto pushes wax compound 34 deeper and deeper into a permeable layer of strands 24. That is, wax compound 34 absorbs into the strand material (e.g., leather) and/or to occupies interstitial spaces 36 between adjacent elongate members 32 of strands 24 (e.g., woven nylon or polyester strands).

After wax compound 34 is applied to strands 24, mesh pocket 12 may then be broken in, such as by using the stick to throw and catch a ball for, e.g., one hour. During this break-in process, wax compound 34 that is applied to mesh pocket 12 is impregnated into strands 24 will be fractured. Some of wax compound 34 may be broken away from strands 24 and fall from mesh pocket 12.

Wax compound 34 improves the speed and accuracy with which the ball may be thrown, and also allows the ball to be held and carried with ease because of the tacking agent used in conjunction wax compound 34. It is believed that once a mesh pocket 12 with wax compound 34 applied thereto has been broken in, wax compound 34 that remains in strands 24 is sufficient to provide mesh pocket 12 with a memory characteristic similar to that of a hard mesh. The memory characteristic enables the player to shoot a ball with increased accuracy and velocity. However, prior to breaking in mesh pocket 12 with wax compound 34 applied thereto, mesh pocket 12 has the characteristics of a soft mesh, namely increased cushioning and permitting better carrying capabilities than a hard mesh.

Additionally, wax compound 34 has a waterproofing effect that reduces the amount of water that is absorbed into strands 24, e.g. if stick 10 is used outside when it is raining. For example, the amount of water that is absorbed into strands 24 that are impregnated with wax compound 34 may be less than half of the amount of water that is absorbed into strands 24 that are not impregnated with wax compound 34. This in turn reduces the amount that strands 24 stretch when stick 10 is used.

Furthermore, wax compound 34 allows mesh pocket 12 to retain its shape. In particular, by treating a soft nylon or polyester mesh pocket 12 with wax compound 34, a shape of mesh pocket 12 may be customized by a player. For example, the player may break in stick 10 to position the pocket at a preferred location. This may be achieved by the player breaking in mesh pocket 12, for example by applying pressure or force to mesh pocket 12 in a particular area to break, fracture or otherwise affect wax compound 34 in strands 24 so that mesh pocket 12 retains the desired shape.

In addition to the above benefits, wax compound 34 acts as a tacking agent to increase ball control within mesh pocket 12.

In some embodiments, wax compound 34 may be impregnated into only a portion of each strand 24. For example, in the embodiment shown in FIG. 2*a*, where mesh pocket 12 has concavity 28, wax compound 34 may be impregnated into the portion of strands 24 defining concavity 28. In other embodiments, wax compound 34 may be impregnated into only some strands 24 of mesh pocket 12. For example, wax compound 34 may be impregnated into every other strand 24. Such configurations, where wax compound 34 is impregnated into only some strands 24 or into only a portion of each strand 24, may be useful when it is desired that different portions 38, 36, 40 of mesh pocket 12 to have different properties or to be used for different purposes. However, because wax compound 34 provides the ability to throw a ball with speed and accuracy, and also allows the ball to be held and carried with ease, in the preferred embodiment, wax compound is impregnated into substantially the entirety of each one of substantially all strands 24.

Wax compound 34 may be selected from a variety waxes, including petroleum waxes, vegetable waxes, mineral waxes, animal waxes, synthetic waxes, and combinations thereof. In the preferred embodiment, wax compound 34 is a paraffin wax.

Wax compound 34 may be applied to mesh pocket 12, preferably where the wax is provided in a retractable applicator 500. In such an application, retractable applicator 500 is used to apply wax compound 34 without the need to melt wax compound 34 or heat mesh pocket 12. Further, such an application enables one to apply wax compound 34 to mesh pocket 12 while mesh pocket 12 is secured to frame 18 of stick 10 and without the need to disassemble mesh pocket 12 from frame 18.

Figure 6A:
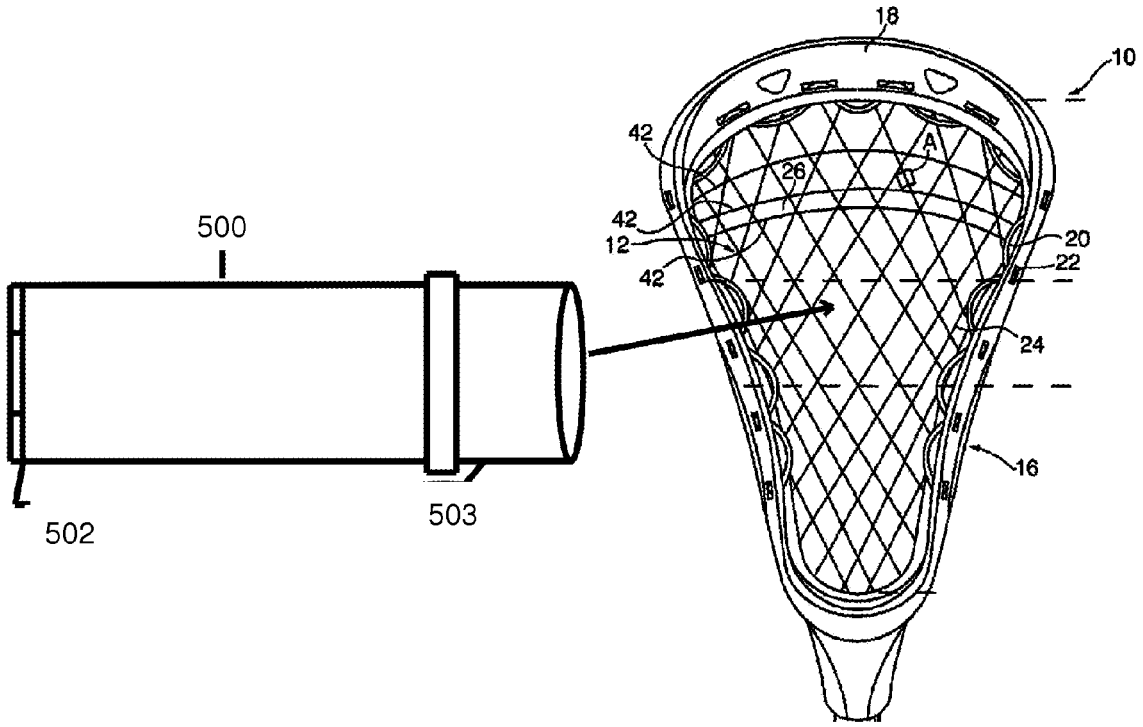
FIG. 6*a* illustrates the retractable applicator with a cap is shown alongside a head portion of a lacrosse stick as useful in performing steps of one embodiment of a method of treating a mesh pocket of the present invention.

Referring now to FIGS. 6, 6*a* and 7, one embodiment of a method 600 of treating a mesh pocket 12 is discussed. FIGS. 6 and 6*a* illustrate an embodiment of retractable applicator 500 without removable cap 503 and with removable cap 503, respectively. In each figure, a front view of head portion 16 of lacrosse stick 10 is also shown to further illustrate the steps of method 600, which is discussed below.

FIG. 7 illustrates a flow chart illustrating the steps of one embodiment of method 600. Any or all of the steps of method 600 may be performed manually. Preferably, any or all of the steps of method 600 may be performed while mesh pocket 12 is secured to frame 18. Method 600 may also be performed with mesh pocket 12 separated from frame 18 (e.g., as provided by itself when mesh pocket 12 is sold as a replacement part).

In step 602, wax compound 34 is provided. Preferably wax compound 34 is provided disposed in a retractable applicator 500 that includes removable cap 503 as discussed above. In step 603, if wax compound 34 is provided in retractable applicator 500, removable cap 503 is removed.

In step 604, wax compound 34 is exposed. If needed, the user advances wax compound 34 through tubular body 504 so that wax compound 34 extends beyond distal open end 506 of tubular body 504.

In step 605, wax compound 34 is applied to strands 24 by moving, pressing, and/or rubbing wax compound 34 against strands 24 of mesh pocket 12. In step 606, removable cap 503 is installed over distal open end 506 of retractable applicator 500. In step 607, removable cap 503 is optionally pressed against strands 24 having wax compound 34 applied thereto to further penetrate wax compound 34 deeper into elongated members 32 of strands 24, therefore further impregnating strands 24 with wax compound 34. In step 608, the user optionally breaks-in mesh pocket 12 with wax compound 34 applied thereto.

It will be appreciated that certain features of the invention, which, for clarity, are described in the context of separate embodiments or separate aspects, may also be provided in combination in a single embodiment. Conversely, various features of the invention, which, for brevity, are described in the context of a single embodiment or aspect, may also be provided separately or in any suitable sub-combination.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A method of treating a mesh pocket of a lacrosse stick, the method comprising:

providing a solid wax compound in a retractable applicator capable of adjustably moving the solid wax compound to extend beyond a distal end opening of the retractable applicator;

providing a removable cap on the retractable applicator;

providing a mesh pocket usable with a lacrosse stick comprising a plurality of inter-engaged strands defining a plurality of mesh openings;

manually applying the solid wax compound to at least a portion of at least some of the plurality of inter-engaged strands of the mesh pocket; and pressing the removable cap against the plurality of inter-engaged strands having the solid wax compound applied thereto to cause the solid wax compound to absorb into or occupy a plurality of interstitial spaces of each of the plurality of inter-engaged strands of the mesh pocket.

2. The method according to claim 1, wherein the step of providing a mesh pocket includes providing a lacrosse stick having a head portion with the mesh pocket secured to the head portion.

3. The method according to claim 1, wherein the step of manually applying the solid wax compound includes pressing the solid wax compound into interstitial spaces defined between adjacent ones of a plurality of elongate members that form each of the plurality of inter-engaged strands.

4. The method according to claim 1, wherein each of the plurality of inter-engaged strands is made of nylon and lacks a liquid rope whipping agent.

5. The method according to claim 1, wherein each of the plurality of inter-engaged strands is made of polyester.

6. The method according to claim 1, wherein the solid wax compound comprises at least one component selected from the group consisting of a petroleum wax, a vegetable wax, a mineral wax, an animal wax, a synthetic wax, and a paraffin wax.

7. The method according to claim 1, wherein the step of manually applying the solid wax compound against each of the plurality of inter-engaged strands of the mesh pocket includes impregnating substantially all portions of substantially all of the inter-engaged strands with the solid wax compound.

8. The method according to claim 1, wherein the step of manually applying the solid wax compound against at least a portion of at least some of the plurality of inter-engaged strands of the mesh pocket includes applying the solid wax compound to a first side and to an opposite second side of the mesh pocket.

* * * * *